US011277688B2

(12) United States Patent
Ozcan et al.

(10) Patent No.: US 11,277,688 B2
(45) Date of Patent: Mar. 15, 2022

(54) APPARATUS, METHOD AND COMPUTER PROGRAM FOR AUDIO MODULE USE IN AN ELECTRONIC DEVICE

(71) Applicant: NOKIA TECHNOLOGIES OY, Espoo (FI)

(72) Inventors: Koray Ozcan, Hampshire (GB); Miikka Vilermo, Siuro (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/313,681

(22) PCT Filed: Jun. 14, 2017

(86) PCT No.: PCT/FI2017/050442
§ 371 (c)(1),
(2) Date: Dec. 27, 2018

(87) PCT Pub. No.: WO2018/002421
PCT Pub. Date: Jan. 4, 2018

(65) Prior Publication Data

US 2019/0261084 A1 Aug. 22, 2019

(30) Foreign Application Priority Data

Jun. 30, 2016 (GB) ..... 1611376

(51) Int. Cl.
*H04R 3/04* (2006.01)
*H04R 1/02* (2006.01)
*H04R 5/04* (2006.01)

(52) U.S. Cl.
CPC ..... *H04R 3/04* (2013.01); *H04R 1/025* (2013.01); *H04R 5/04* (2013.01); *H04R 2420/03* (2013.01);
(Continued)

(58) Field of Classification Search
CPC ..... H04R 5/04; H04R 1/025; H04R 2420/03; H04R 2420/05; H04R 2499/11
(Continued)

(56) References Cited

U.S. PATENT DOCUMENTS 6,191,942 B1 2/2001 Lee et al.
6,359,777 B1 3/2002 Newman et al.
(Continued)

FOREIGN PATENT DOCUMENTS

CN 101179871 A 5/2008
CN 102668523 A 9/2012
(Continued)

OTHER PUBLICATIONS

International Search Report and Written Opinion for Application No. PCT/FI2017/050442 dated Sep. 11, 2017, 21 pages.
(Continued)

*Primary Examiner* — Vivian C Chin
*Assistant Examiner* — Con P Tran
(74) *Attorney, Agent, or Firm* — Alston & Bird LLP

(57) ABSTRACT

An apparatus, electronic device, method and computer program wherein the apparatus comprises: processing circuitry; and memory circuitry including computer program code, the memory circuitry and the computer program code configured to, with the processing circuitry, enable the apparatus to: detect an audio module connected to the apparatus wherein the audio module comprises a user replaceable module; determine one or more parameters of the audio module; and enable the processing of the signals used for the audio module in accordance with the determined one or more parameters.

21 Claims, 7 Drawing Sheets

(52) U.S. Cl.
CPC ..... *H04R 2420/05* (2013.01); *H04R 2499/11* (2013.01)

(58) Field of Classification Search
USPC ..... 381/59, 58, 122, 150; 361/728, 679.01; 324/757.05
See application file for complete search history.

(56) References Cited

U.S. PATENT DOCUMENTS

| | | | | |
|---|---|---|---|---|
| 6,845,408 | B1 | 1/2005 | Lemke et al. | |
| 8,112,060 | B2 | 2/2012 | Sip | |
| 8,233,637 | B2 | 7/2012 | Phelps et al. | |
| 8,292,023 | B2 | 10/2012 | Slotte | |
| 8,362,654 | B2 | 1/2013 | Inha et al. | |
| 8,571,694 | B1 | 10/2013 | Koski et al. | |
| 9,301,047 | B2 | 3/2016 | Chua et al. | |
| 2008/0112572 | A1 | 5/2008 | Wong et al. | |
| 2012/0128174 | A1 | 5/2012 | Tammi et al. | |
| 2012/0257776 | A1 | 10/2012 | Ozcan | |
| 2012/0294450 | A1 | 11/2012 | Ozcan | |
| 2013/0267275 | A1 | 10/2013 | Onishi et al. | |
| 2014/0105440 | A1 | 4/2014 | Mittleman et al. | |
| 2014/0193024 | A1 | 7/2014 | Raff | |
| 2015/0201258 | A1* | 7/2015 | Han | H04R 1/023 381/386 |
| 2015/0237440 | A1 | 8/2015 | Fromel et al. | |
| 2015/0289273 | A1 | 10/2015 | Ermenko et al. | |
| 2015/0296291 | A1 | 10/2015 | Macours | |
| 2015/0309534 | A1* | 10/2015 | Osterhout | G06F 3/016 345/8 |
| 2016/0021453 | A1 | 1/2016 | Ozcan | |
| 2016/0232888 | A1* | 8/2016 | Short | H04M 1/6008 |

FOREIGN PATENT DOCUMENTS

| | | | |
|---|---|---|---|
| CN | 202602754 | U | 12/2012 |
| CN | 103283259 | A | 9/2013 |
| CN | 103686535 | A | 3/2014 |
| EP | 2 661 100 | A1 | 11/2013 |
| WO | WO 2009/085785 | A2 | 7/2009 |
| WO | WO 2009/089393 | A1 | 7/2009 |
| WO | WO 2013/093552 | A1 | 6/2013 |

OTHER PUBLICATIONS

A Module Phone: Design Your Own Smartphone [online] [Retrieved Jan. 23, 2019]. Retrieved from the Internet: <URL: https://articles.informer.com/a-modular-phone-design-your-own-smartphone.html>. (dated 2019) 4 pages.

Nexpaq—another modular case for smartphones. Available on Kickstarter now, [online] [Retrieved Jan. 23, 2019]. Retrieved from the Internet: <URL: http://www.modularphonesforum.com/news/nexpaq-module-case-for-smartphones-1960/> (dated May 4, 2015) 16 pages.

HTC One (M7) Repair—iFixit [online] [Retrieved Jan. 23, 2019]. Retrieved from the Internet: <URL: https://www.ifixit.com/Device/HTC_One>. (undated) 4 pages.

Office Action for Chinese Application No. 201780040363.X dated Sep. 4, 2019, 24 pages.

Office Action for Chinese Application No. 201780040363.X dated Apr. 26, 2020, 10 pages.

Extended European Search Report for Application No. 17 81 9407 dated Mar. 30, 2020, 9 pages.

Office Action for Chinese Application No. 201780040363.X dated Oct. 30, 2020, 10 pages.

Office Action for European Application No. 17819407.2 dated Nov. 17, 2021, 9 pages.

* cited by examiner

APPARATUS, METHOD AND COMPUTER PROGRAM FOR AUDIO MODULE USE IN AN ELECTRONIC DEVICE

CROSS-REFERENCE TO RELATED APPLICATIONS

The present application is a national phase entry of International Application No. PCT/FI2017/050442, filed Jun. 14, 2017, which claims priority to GB Application No. 1611376.3, filed Jun. 30, 2016, all of which are incorporated herein by reference in their entirety.

TECHNOLOGICAL FIELD

Examples of the disclosure relate to an apparatus, method and computer program for audio module use in an electronic device. In particular they relate to an apparatus, method and computer program for audio module use in an electronic device where the audio module is arranged to be user replaceable.

BACKGROUND

Electronic devices comprising audio transducers such as microphones or speakers are well known. Such devices could comprise mobile telephones, camera devices, computers or any other suitable devices. Typically the audio transducers are integrated into the electronic device. This makes the audio transducers difficult to repair or replace.

BRIEF SUMMARY

According to various, but not necessarily all, examples of the disclosure there is provided an apparatus comprising: processing circuitry; and memory circuitry including computer program code, the memory circuitry and the computer program code configured to, with the processing circuitry, enable the apparatus to: detect an audio module connected to the apparatus wherein the audio module comprises a user replaceable module; determine one or more parameters of the audio module; and enable the processing of the signals used for the audio module in accordance with the determined one or more parameters.

The audio module may comprise an audio transducer.

The audio module may comprise an acoustic cavity.

The audio module may comprise at least one sound outlet.

The processing of the signals may be modified so that different processing is used for different audio modules. Modifying the processing of the signals used for the audio module may comprise changing algorithms used for processing the signals. Modifying the processing of the signals used for the audio module may comprise modifying signals in an electrical domain. Modifying the processing of the signals used for the audio module may comprise modifying signals in an acoustic domain.

The one or more parameters of the audio module may comprise at least one of; a frequency response, a type of transducer, a specification of the transducer.

Determining the one or more parameters of the audio module may comprise detecting metadata provided by the audio module, detecting a ground pin location of the audio module, determining a frequency response of the audio module The one or more parameters of the audio module may comprise a position of the audio module. Determining a position of an audio module comprises providing an audio signal and then detecting whether or not a response signal is above a threshold.

The processing circuitry and memory circuitry may be configured to enable providing an indication of the optimal position for an audio module. The indication may be provided in response to detecting user selection of a mode of operation of the apparatus.

The apparatus may be arranged to detect a plurality of audio modules simultaneously connected to the apparatus and to determine the one or more parameters for each of the plurality of audio modules.

According to various, but not necessarily all, examples of the disclosure there may be provided an electronic device comprising an apparatus as described above.

The electronic device may comprise one or more connecting portions arranged to receive one or more user replaceable audio modules.

The user replaceable audio module may comprise part of the housing of the electronic device.

According to various, but not necessarily all, examples of the disclosure there may be provided an audio module arranged to be connected to an apparatus as described above such that the audio module can be disconnected and reconnected by a user.

The audio module may comprise at least one of; a speaker, a microphone, an audio cavity, a seal.

The audio module may form part of the housing of an electronic device.

According to various, but not necessarily all, examples of the disclosure there may be provided a method comprising: detecting an audio module connected to the apparatus wherein the audio module comprises a user replaceable module; determining one or more parameters of the audio module; and enabling the processing of the signals used for the audio module in accordance with the determined one or more parameters.

The audio module may comprise an audio transducer.

The audio module may comprise an acoustic cavity.

The audio module may comprise at least one sound outlet.

The processing of the signals may be modified so that different processing is used for different audio modules. Modifying the processing of the signals used for the audio module may comprise changing algorithms used for processing the signals. Modifying the processing of the signals used for the audio module may comprise modifying signals in an electrical domain.

Modifying the processing of the signals used for the audio module may comprise modifying signals in an acoustic domain.

The one or more parameters of the audio module may comprise at least one of; a frequency response, a type of transducer, a specification of the transducer.

Determining the one or more parameters of the audio module may comprise detecting metadata provided by the audio module, detecting ground pin location of the audio module, determining frequency response of the audio module The one or more parameters of the audio module may comprise a position. Determining a position of an audio module may comprise providing an audio signal and then detecting a response signal is above a threshold.

The method may comprise providing an indication of the optimal position for an audio module. The indication may be provided in response to detecting user selection of a mode of operation of the apparatus.

The method may comprise detecting a plurality of audio modules simultaneously connected to an apparatus and determining the one or more parameters for each of the plurality of audio modules.

According to various, but not necessarily all, examples of the disclosure there may be provided a computer program comprising computer program instructions that, when executed by processing circuitry, enable: detecting an audio module connected to the apparatus wherein the audio module comprises a user replaceable module; determining one or more parameters of the audio module; and enabling the processing of the signals used for the audio module in accordance with the determined one or more parameters.

According to various, but not necessarily all, examples of the disclosure there may be provided a computer program comprising program instructions for causing a computer to perform the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, examples of the disclosure there may be provided an apparatus comprising: means for detecting an audio module connected to the apparatus wherein the audio module comprises a user replaceable module;

means for determining one or more parameters of the audio module; and means for enabling the processing of the signals used for the audio module in accordance with the determined one or more parameters.

According to various, but not necessarily all, examples of the disclosure there may be provided an apparatus comprising means for enabling the methods described above.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to: detect selection of an audio application; identify an optimal arrangement for the positions of a plurality of audio modules within an electronic device for the audio application; and provide an indication to the user of the optimal arrangement of the plurality of audio modules.

The audio modules may comprise one or more microphones.

The indication may enable a user to manually change the positions of one or more of the audio modules within the electronic device.

The indication may comprise a visual indication.

The audio application may be selected by a user indicating a preferred use for an electronic device.

The audio application may be selected automatically.

According to various, but not necessarily all, examples of the disclosure there may be provided a method comprising: detecting selection of an audio application; identifying an optimal arrangement for the positions of a plurality of audio modules within an electronic device for the audio application; and providing an indication to the user of the optimal arrangement of the plurality of audio modules.

The audio modules may comprise one or more microphones.

The indication may enable a user to manually change the positions of one or more of the audio modules within the electronic device.

The indication may comprise a visual indication.

The audio application may be selected by a user indicating a preferred use for an electronic device.

The audio application may be selected automatically.

According to various, but not necessarily all, examples of the disclosure there may be provided a computer program comprising computer program instructions that, when executed by processing circuitry, enable: detecting selection of an audio application; identifying an optimal arrangement for the positions of a plurality of audio modules within an electronic device for the audio application; and providing an indication to the user of the optimal arrangement of the plurality of audio modules.

According to various, but not necessarily all, examples of the disclosure there may be provided a computer program comprising program instructions for causing a computer to perform the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, examples of the disclosure there may be provided an apparatus comprising: means for detecting selection of an audio application;

means for identifying an optimal arrangement for the positions of a plurality of audio modules within an electronic device for the audio application; and means for providing an indication to the user of the optimal arrangement of the plurality of audio modules.

According to various, but not necessarily all, examples of the disclosure there may be provided an apparatus comprising means for enabling the methods described above.

According to various, but not necessarily all, examples of the disclosure there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
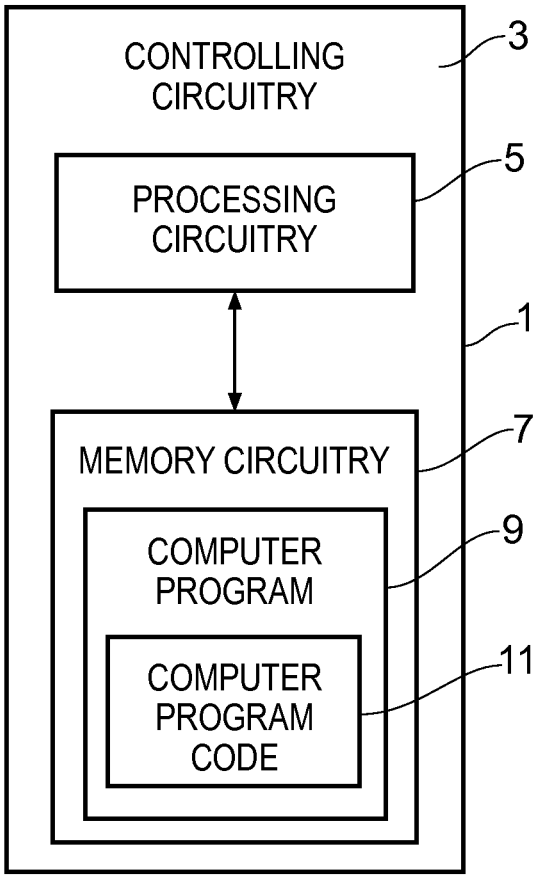
FIG. 1 illustrates an apparatus.

The Figures illustrate an apparatus 1 comprising: processing circuitry 5; and memory circuitry 7 including computer program code 11, the memory circuitry 7 and the computer program code 11 configured to, with the processing circuitry 5, enable the apparatus 1 to perform: detecting an audio module 23 connected to the apparatus 1 wherein the audio module 23 comprises a user replaceable module; determining one or more parameters of the audio module 23; and enabling the processing of the signals used for the audio module 23 in accordance with the determined one or more parameters.

The Figures also illustrate an apparatus 1 comprising: processing circuitry 5; and memory circuitry 7 including computer program code 11, the memory circuitry 7 and the computer program code 11 configured to, with the processing circuitry 5, enable the apparatus 1 to perform: detecting selection of an audio application; determining an optimal arrangement of a plurality of audio modules 23 within an electronic device 21 for the audio application; and providing an indication to the user of the optimal arrangement of the plurality of audio modules 23.

The apparatus 1 may be for processing audio signals. The audio signals may be audio input signals which are provided from a microphone or audio output signals which are provided to a speaker or any other suitable type of audio signals.

Figure 2:
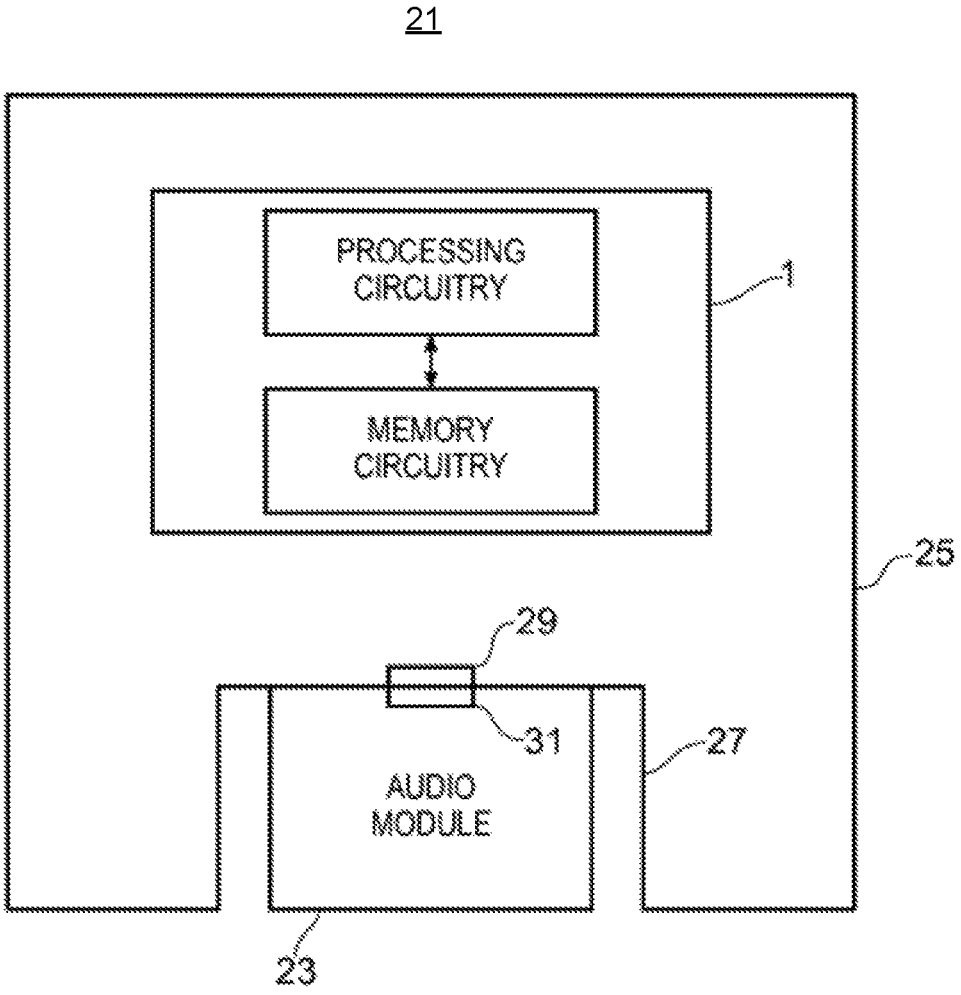
FIG. 2 illustrates an electronic device comprising an apparatus and an audio module.

FIG. 1 schematically illustrates an apparatus 1 according to examples of the disclosure. The apparatus 1 illustrated in FIG. 1 may be a chip or a chip-set. In some examples the apparatus 1 may be provided within an electronic device 21. The electronic device 21 could be a mobile phone, a computer, a camera or any other suitable type of electronic device. The electronic device 21 may be configured to receive one or more user replaceable audio modules 23. Examples of an electronic device 21 are shown in FIG. 2.

The example apparatus 1 comprises controlling circuitry 3. The controlling circuitry 3 may provide means for controlling an electronic device 21. The controlling circuitry 3 may also provide means for performing the methods or at least part of the methods of examples of the disclosure.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods illustrated in FIG. 7. The processing circuitry 5 by reading the memory circuitry 7 is able to load and execute the computer program 9.

In some examples the computer program 9 may comprise an audio module detection application. The audio module detection application may be configured to detect an audio module 23 connected to the apparatus 1 wherein the audio module 23 comprises a user replaceable module; determine one or more parameters of the audio module 23; and modify the processing of the signals used for the audio module 23 in accordance with the determined one or more parameters.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus may propagate or transmit the computer program 9 as a computer data signal. In some examples the computer program code 11 may be transmitted to the apparatus 1 using a wireless protocol such as Bluetooth, Bluetooth Low Energy, Bluetooth Smart, 6LoWPan (IP$_v$6 over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semipermanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

FIG. 2 schematically illustrates an example electronic device 21 comprising an apparatus 1, a housing 25 and an audio module 23. The electronic device 21 may comprise other components that are not illustrated in FIG. 2. For instance, in some examples the electronic device 21 may comprise a user interface, a transceiver, an image capturing device or any other suitable component. The electronic device 21 may be any suitable type of electronic device 21, such as a mobile telephone, camera device, computer, tablet or any other suitable device.

The apparatus 1 may be as described above and corresponding reference numerals are used for corresponding features.

The housing 25 provides an external housing for the electronic device 1. When the user is holding or using the electronic device 21 they may touch the housing 25. The apparatus 1 is provided within the housing 25. The apparatus 1 may be entirely contained within the housing 25.

The housing 25 may provide protection for the apparatus 1 and other components of the electronic device 21. For example, the housing 25 may protect the components of the electronic device 1 from atmospheric conditions such as moisture or temperature variations.

The housing 25 may also be configured to protect the components of the electronic device 1 from impact forces.

The housing 25 may comprise one or more receiving sections 27. The one or more receiving sections 27 may be sized and shaped so as to receive an audio module 23. The receiving section 27 may comprise a cavity within the housing 25.

The receiving section 27 may comprise one or more contacts 29. The contacts 29 may be arranged to enable an electrical connection to be established with an audio module 23 when an audio module is positioned within the receiving section 27. The electrical connection may enable input signals to be provided from the apparatus 1 to the audio module 23 and may enable output signals to be provided from the audio module 23 to the apparatus 1. The electrical connection may be a direct electrical connection, an inductive electrical connection or any other suitable connection.

The audio module 23 may be a user replaceable module 23. The audio module 23 may be inserted and removed from the receiving section of the housing 25 by a user. The audio module 23 may be inserted and removed from the receiving section 27 of the housing 25 without the need for any tools or other special implements. This may enable the audio module 23 to be connected to and disconnected from the apparatus 1 as needed.

The audio module 23 may comprise an audio transducer. The audio transducer may comprise any means which may be arranged to convert an acoustic signal into an electric signal and/or to convert an electric signal into an acoustic signal. The audio transducer may comprise a microphone, a speaker, a hands free speaker, earpiece, vibra or any other suitable transducer.

In some examples the audio module 23 may comprise an acoustic cavity and/or a seal. In such examples the audio module 23 may comprise a self contained audio module 23. The audio module 23 may be self contained in that the acoustic cavity and/or the seal may be entirely contained within the audio module 23. The acoustic cavity and/or seal may be contained within the audio module 23 so that when the audio module 23 is removed from the electronic device 21 the acoustic cavity and/or seal is also removed from the electronic device 21.

When the audio module 23 is inserted into the receiving section the audio module 23 may comprise part of the housing 25 of the electronic device 21. An outer surface of the audio module 23 may be arranged to provide part of the outer surface of the housing 25. The audio module 23 may comprise a sound outlet 33 which provides an aperture through which an acoustic signal can be provided to the transducer and/or through which an acoustic signal can be provided from the transducer. The one or more sound outlets 33 may be arranged to guide acoustic signals towards or away from the transducer. The sound outlet 33 may be arranged so that it is provided as part of the housing 25 of the electronic device 21.

The electronic device 21 may be arranged to enable different audio modules 23 to be inserted into the same receiving section 27. In some examples of the disclosure each of the audio modules 23 may have the same external size and shape so that they can be received within the same receiving section 27.

Each of the different audio modules 23 may comprise different transducers having different parameters. In some examples the size and shape of the transducers and an acoustic cavity within the audio module 23 may be different for different audio modules 23. This may enable different audio modules 23 with different frequency responses to be provided. Different audio modules 23 may be arranged for different uses. For instance in examples where the electronic device 21 comprises a portable electronic device some modules may be arranged for use in a hands free communication application while another audio module 23 may be arranged for hand held communication applications or any other suitable use.

Different audio modules 23 having different types of transducers may be provided in some examples of the disclosure. For instance, in some examples the audio modules 23 may comprise one or more speakers while other audio modules 23 may comprise one or more microphones.

In some examples the audio module 23 may comprise one or more electronic components. The electronic components may be arranged to enable signals captured by a transducer to be processed before being provided to an apparatus 1, or to enable signals provided from an apparatus 1 to be processed before being provided to the transducer. The electronic components may comprise any suitable components. For example, the electronic components may comprises one or more amplifiers, a signal processor, passive electronic components or any other suitable components.

The audio module 23 also comprises one or more contacts 31. The contact 31 may be arranged to couple with the contacts 29 of the housing 25 to enable an electrical connection to be established with the apparatus 1 when the audio module 23 is inserted into the receiving section 27. The one or more contacts 31 may provide an electrical terminal which enables the audio module 23 to interface with the apparatus 1 and other components of the electronic device 21.

When the audio module 23 is inserted into the receiving section 27 the apparatus 1 is arranged to detect that the audio module 23 has been connected. The apparatus 1 may also be arranged to determine one or more parameters of the audio module 23. The parameters may relate to any feature of the audio signals provided by the audio modules 23 and/or the components of the audio module 23 that enable operation of the audio module 23. The parameters could comprise any one or more of; the frequency response, the type of transducer, a specification of the transducer or any other suitable parameter.

The apparatus 1 may be arranged to use any suitable means to determine the parameters of the audio module 23. In some examples the audio module 23 may provide metadata to the apparatus 1 which may contain information indicative of the parameters of the audio module 23. The metadata could be provided in an output signal when the audio module 23 is connected to the apparatus 1. In some examples the metadata could be read from the audio module 23 by the apparatus 1 or other component of the electronic device 21. For instance, a bar code, colour code, quick response (QR) code or other readable tag could be provided on the audio module 23 and used to provide information to the apparatus 1. In some examples the audio module 23 may be arranged to provide a signal comprising an indication of the parameters of the audio module 23 when the audio modules 23 is inserted into the electronic device 21. The signal maybe provided from the audio module to the apparatus 1 and may comprise an identification of the audio module 23 and any other suitable information.

In some examples electrical methods may be used to determine the parameters of the audio module 23. For instance, in some examples it may be detected that an audio module 23 is connected to the apparatus by monitoring the electrical impedance of the electrical connection 29 in a receiving section 27. When an audio module 23 is connected and/or disconnected this will alter the impedance of the electrical connection. The change in the impedance can be detected by the apparatus 1.

In some examples the apparatus 21 may determine one or more parameters of the audio module 23 by determining the location of a ground pin on the audio module 23. The location of the ground pin may be determined by monitoring the impedance of the one or more contacts of the audio module 23. The location of the ground pin may provide information about the type of audio modules 23. For instance it may provide information about the type of transducer provided within the audio module 23.

In some examples an audio module 23 comprising a speaker may be determined by using one or more microphones within the electronic device 21 or other audio modules 23. The speakers may be determined by analyzing the signals captured by a microphone when the speaker is active.

In some examples the apparatus 1 may determine one or more parameters of the audio module 23 by determining a frequency response of the audio module 23. This may provide information about the quality of the transducer within the audio module 23. For instance if a signal provided by the audio module 23 comprises mostly low frequency content then the audio module 23 may be determined to be a vibra. Low frequency content may comprise audio signals with a frequency below 1 KHz. If a signal provided by the audio module 23 comprises a wide frequency range then the audio module 23 may be determined to be a speaker. A wide frequency range may comprise audio signals with a frequency between about 300 Hz and 8 kHz. If a signal provided by the audio module 23 comprises a narrow frequency range then the audio module 23 may be determined to be an earpiece. A narrow frequency range may comprise audio signals with a frequency between about 340 Hz and 3.54 kHz. The frequency content may be obtained by any suitable method such as finding the frequency where the maximum level is reached and then finding the lower and upper frequency limits where the signal level is at a predetermined threshold below the maximum. In some examples the bandwidth may be defined by network settings, by the electronic device 21, by the application in which the audio module 23 is intended for use or by any other suitable factor. Different bandwidths may be used for different applications.

In examples the apparatus may determine the one or more parameters of the audio module 23 by analyzing an audio signal recorded by the microphone or provided by a speaker. The apparatus 1 may determine parameters such as the bandwidth of the signal and/or the dynamic range of the signal. The bandwidth of the signal may be determined by any suitable method such as obtaining a long term average of the microphone signal and finding the lowest and highest frequency within the signal. The lowest and highest frequency may be above a preset threshold. The dynamic range of the signal may be determined by any suitable method such as obtaining a long term average of the microphone signal and comparing the loudest values to the quietest values. It is to be appreciated that in such examples the long term average for audio modules 23 comprising a speaker would only be obtained for time periods where the speaker is active. In examples where the audio modules 23 comprise a microphone the long term average might only be obtained for time periods where the acoustic signal from the speaker is known to have sufficient frequency and/or dynamic range.

In some examples the one or more parameters of the audio module 23 that are detected could be the position of the audio module 23. For instance in some examples the electronic device 21 may comprise a plurality of different receiving sections 27. The same audio module 23 may be inserted into different receiving sections 27. The apparatus 1 may determine that the audio module 23 has been inserted into a particular receiving section 27 by providing an audio signal and then detecting that a response signal, from the particular receiving section is above a threshold.

Once the parameters of the audio module have been determined the apparatus 1 is arranged to modify the processing of signals used for the audio module 23. The signals could be the input signals that are provided from the apparatus 1 to the audio module 23. In some examples the signals could be the output signals that are provided from the audio signal 23. The audio signals may be in an acoustic domain or an electrical domain.

The modifying of the processing of the signals for used for the audio module 23 may comprise changing algorithms used for processing the signals. The algorithms may be changed to optimise the audio signals in accordance with the one or more parameters that are determined by the apparatus 1. For instance if it is determined that the transducer of the audio module 23 has a particular frequency response the processing may be optimised for that frequency response. If it is determined that the audio modules 23 are arranged in a particular location the processing may be optimised for the determined positions of the audio modules 23.

In some examples the apparatus 1 may comprise a plurality of different algorithms which may be selected in response to the determined one or more parameters of the audio modules. The different algorithms may be stored in the memory circuitry 5 of the apparatus 1. When the parameters of the audio module 23 are determined the algorithm that is optimal for use with the audio module 23 may be retrieved from the memory circuitry 5 and used for the audio signals.

Figure 3A:
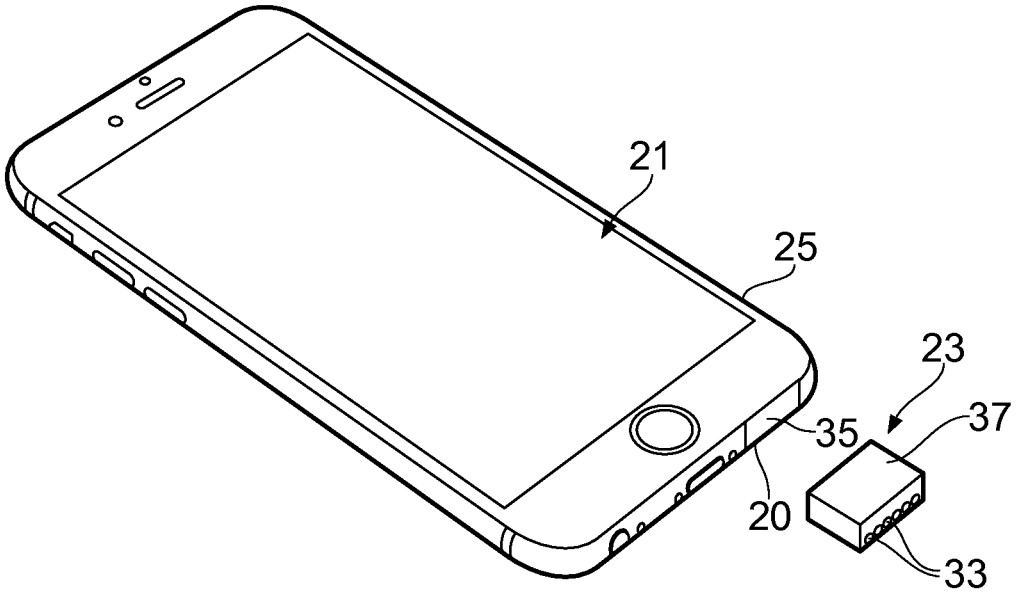
FIGS. 3A to 3B illustrate an electronic device and an audio module.
Figure 3B:
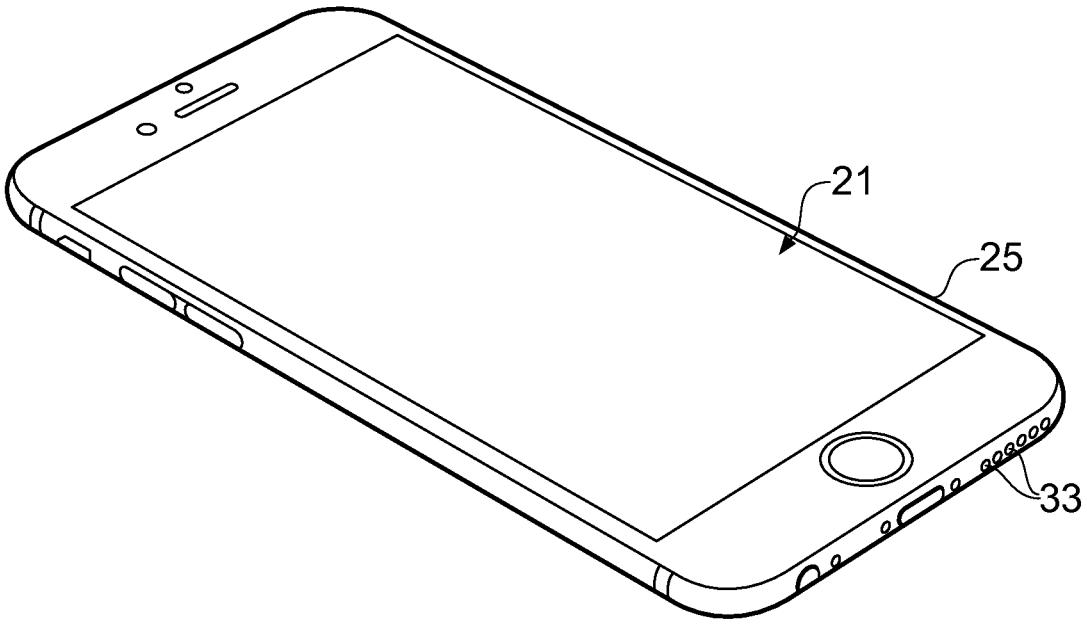

FIGS. 3A to 3B illustrate an electronic device 21 and an audio module 23 which may be provided in some examples of the disclosure.

In the examples of FIGS. 3A and 3B the electronic device 21 is a mobile telephone. Other types of electronic device 21 may be used in other examples of the disclosure. The electronic device 21 comprises an apparatus 1 such as the apparatus 1 of FIG. 1. The apparatus 1 is contained within the housing 25 and is not illustrated in FIGS. 3A and 3B.

In the example of FIG. 3A the audio module 23 is not inserted into the receiving section 27 of the housing 25. The receiving section 27 comprises a cavity 35 in a side of the housing 25. In the example of FIG. 3A the cavity 35 is provided in a lower side of the housing 25. The cavity 35 may be located in other positions in other examples of the disclosure. In some examples more than one cavity 35 may be provided within the electronic device 21.

The contacts 29 which enable an electrical connection to be established between the apparatus 1 and the audio module 23 may be provided within the cavity 33. The contacts 29 are not shown in FIGS. 3A and 3B.

The audio module 23 is sized and shaped so as to fit into the cavity 35. The audio module 23 has an external casing 37. The external casing 37 is sized and shaped so as to fit into the cavity 35 of the housing 25. The external casing 37 houses the transducer and an acoustic cavity and seal. The electrical contacts 31 may be provided on the external casing 37 and is arranged so as to enable an electrical connection to be established with the electrical connection in the cavity 35. In some examples the electrical contacts 31 may be provided within the external casing 37.

In the examples of FIG. 3A a plurality of sound outlets 33 are provided in the external casing 37 of the audio module 23. The sound outlets 33 are acoustically coupled to the transducer and the acoustic cavity within the external casing 37. It is to be appreciated that any number of sound outlets 33 may be provided in other examples of the disclosure. For instance, in some examples the audio module 23 might comprise a single sound outlet 33.

In the example of FIG. 3B the audio module 23 has been inserted into the electronic device 21. A user may insert the audio module 23 into the cavity 35 by pushing the audio module 23 into the cavity 35.

The audio module 23 is entirely received within the cavity 35 so that the surface of the audio module 23 does not project from the surface of the housing 25. The surface of the audio module 23 forms a flush surface with the surface of the housing 25. The sound outlets 33 of the audio module 23 are provided as part of the outer surface of the housing 25.

When the audio module 23 is in the cavity 35 the audio module 23 is connected to the apparatus 1 to enable the controlling circuitry of the apparatus 1 to control the audio module 23. The processing of the audio signals used for the audio module 23 is optimized for the detected parameters of the audio module 23.

The electronic device 21 and the audio module 23 are arranged to enable a user to remove the audio module 23 from the cavity 35. In some examples a mechanical spring or other mechanism may be provided within the cavity 35 to enable the audio module 23 to be released from the cavity 35.

Once the audio module 23 has been removed from the cavity 35 the audio module 23 may be replaced by a different audio module 23. The different audio module 23 may comprise a different type or quality of transducer and/or may be optimized for a different function or may have any other suitable parameters. The different audio module 23 may have an external casing 37 the same size and shape so that it may fit into the same cavity 35.

Figure 4A:
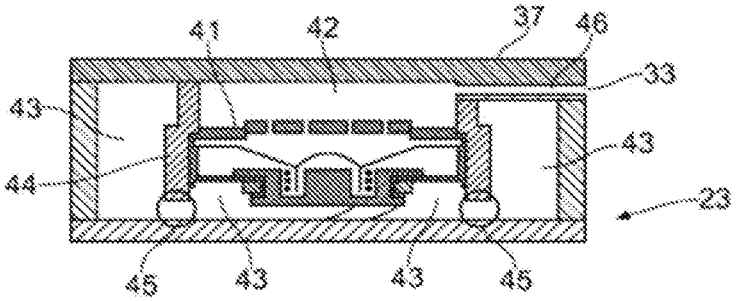
FIGS. 4A to 4C illustrate audio modules.
Figure 4B:
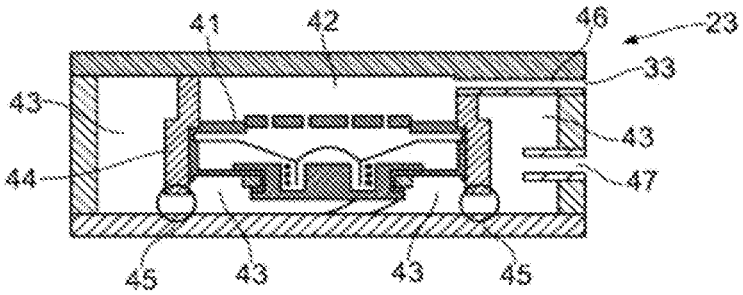
Figure 4C:
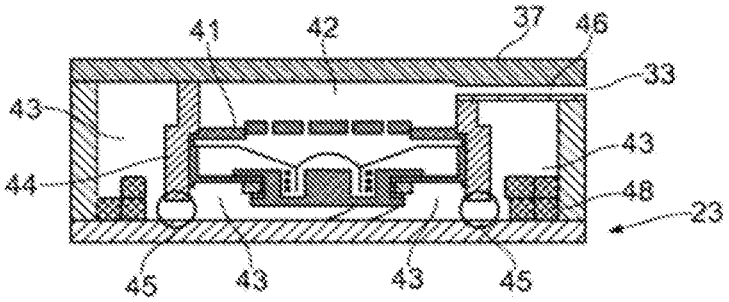

FIGS. 4A to 4C schematically illustrate example audio modules 23 that may be provided in some examples of the disclosure. The audio modules 23 may be used in the example electronic devices 21 as illustrated in FIGS. 2 and 3A to 3B.

In the example audio module 23 of FIG. 4A the transducer comprises a hands free speaker 41 contained within an external housing 37. The hands free speaker 41 may be optimized for use in hands free applications. The audio module 23 comprises a front cavity 42, a back cavity 43, a front cavity seal 44 and leak channels 45. A side port 46 is provided between the front cavity 42 and the sound outlet 33. The arrangement of the transducer and the other components within the audio module 23 may be arranged for a hands free communication application.

In the example of FIG. 4A a side port 46 is provided. It is to be appreciated that different ports may be provided in different implementations. For instance, in some examples a vertical port may be provided.

FIG. 4B illustrates a different audio module 23 which may be used in some examples of the disclosure. The different audio module 23 may be provided within an external housing 37 which has the same size and shape as the audio module 23 of FIG. 4A. This enables a user to replace the audio module 23 of FIG. 4A with the audio module 23 of FIG. 4B.

The audio module 23 of FIG. 4B has a different arrangement of acoustic components to the audio module of FIG. 4B.

In the example of FIG. 4B the transducer also comprises a hands free speaker 41. The audio module 23 also comprises a front cavity 42, a back cavity 43, a front cavity seal 44 and leak channels 45. A side port 46 is provided between the front cavity 42 and the sound outlet 33. In the example of FIG. 4B the audio module 23 also comprises a bass reflex port 47. This provides a different arrangement for the acoustic cavities of the module 23. This may enable the audio module 23 of FIG. 4B to provide a different frequency response to the audio module 23 of FIG. 4A.

FIG. 4C illustrates another different audio module 23 which may be used in some examples of the disclosure. The audio module 23 of FIG. 4C may also be provided within an external housing 37 which has the same size and shape as the audio modules 23 of FIGS. 4A and 4B. The audio module 23 of FIG. 4C has a different arrangement of acoustic components to the audio modules 23 of FIGS. 4A and 4B.

In the example of FIG. 4C the transducer also comprises a hands free speaker 41. The audio module 23 also comprises a front cavity 42, a back cavity 43, a front cavity seal 44 and leak channels 45. A side port 46 is provided between the front cavity 42 and the sound outlet 33. In the example of FIG. 4C the audio module 23 also comprises an adsorbing material 48 provided within the back cavity 43. The adsorbing material 48 may comprise activated carbon, zeolite based materials, graphene, carbon nanotubes or any other suitable adsorbing material. This may enable the audio module 23 of FIG. 4C to provide a different frequency response to the audio module 23 of FIGS. 4A and 4B.

As each of the different audio modules 23 provide a different frequency response the audio signals provided to the audio module 23 from the apparatus 1 can be optimized for the different frequency responses. When the audio module 23 is connected to the housing 25 of the electronic device 21 the apparatus 1 is arranged to determine the frequency response of the audio modules 23 and modify the processing of the audio signals used for the audio module 23.

It is to be appreciated that other audio modules 23 may be arranged to provide different frequency responses in other examples of the disclosure. For instance, in some examples the components of the audio modules 23 may be built with different specifications. In such cases the audio modules 23 may be more expensive but may provide a higher quality sound output. This may enable a user to choose to upgrade the audio module 23 of the electronic device 21 without upgrading the entire electronic device 21.

In each of the example audio modules 23 the differences between the acoustic arrangements are contained within the external housings 37. This enables the different audio modules 23 to be used interchangeably.

In the examples of FIGS. 4A to 4C each of the audio modules 23 are arranged for audio playback. In other examples the audio modules 23 may be arranged for audio capture. In such examples the audio module 23 may comprise one or more microphones.

It is to be appreciated that other variations of different audio modules 23 may be provided in other examples of the disclosure. For instance, in some examples a mesh may be provided over the sound outlets 33. Different audio modules 23 may use different meshes which provide different acoustic resistances.

In some examples the audio modules 23 may comprise additional components such as electro static discharge protection components, components to protect from dust or any other suitable components.

In some examples the audio cavities may have different designs in different audio modules 23.

The differences in the different audio modules 23 may depend on the intended use of the audio module 23 or the electronic device 21. For example, if the audio module 23 is arranged for use in an earpiece it may be arranged to provide a leak tolerant performance. If the audio module 23 comprises a microphone it may provide high amplitude audio capture functionality by comprising two integrated membranes.

In some examples the audio modules 23 may have different aesthetic features. For examples the audio modules 23 may be provided with different colours or patterns on the casing which may enable a user to personalize their electronic device 21. In some examples the sound outlets 33 may be invisible.

Figure 5:
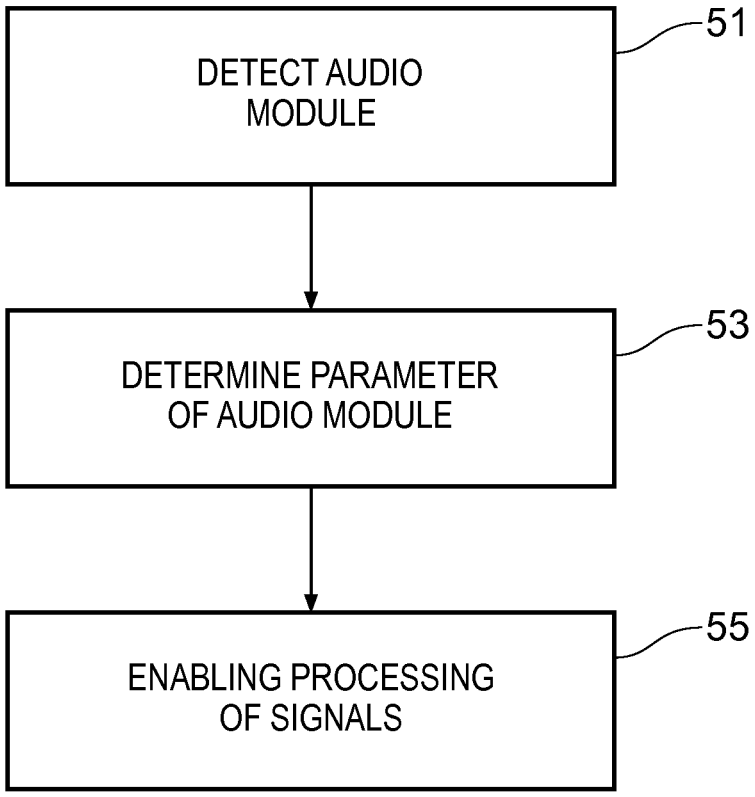
FIG. 5 illustrates a method

FIG. 5 illustrates a method which may be implemented by the apparatus 1 and electronic devices 21 as described above. The method comprises, at block 51, detecting an audio module 23 connected to the apparatus 1 wherein the audio module 23 comprises a user replaceable module. At block 53 the method comprises determining 53 one or more parameters of the audio module 23 and at block 75 the method comprises modifying 55 the processing of the signals used for the audio module 23 in accordance with the determined one or more parameters.

Examples of the disclosure provide an apparatus 1 and electronic device 21 which can be used with user replaceable audio modules 23. The audio modules 23 can be easily connected to and disconnected from the apparatus 1 by a user. This enables the audio modules 23 to be repaired, replaced or upgraded without disassembling the electronic device 21.

This also provides a design flexibility for manufactures of electronic devices 21. This may enable different electronic devices 21 to be provided to different specifications by using a different audio modules 23. The audio performance of the electronic device 21 may be improved by providing a higher quality audio module 23 or a lower cost electronic device 21 may be provided by providing an audio module 23 with a lower specification.

As the apparatus 1 recognises the parameters of the audio module 23 and then modifies the processing of signal used for the audio module 23 this ensures that the audio outputs are optimised for the different audio modules 23 and arrangements of audio modules 23. This also ensures that the audio module 23 can be provided as a self contained audio module 23 which comprises the acoustic cavity and seal as well as the transducer as the apparatus 1 is arranged to provide signals for the different arrangements of the acoustic components within the different audio modules 23.

Any number of audio modules 23 may be provided for the electronic device 21. In some examples the audio modules 23 may be provided separately to the electronic device 21. This may enable the audio modules 23 to be sold separately. For example, a user may purchase an electronic device 21 comprising a first audio module and may also purchase other audio modules to upgrade or personalize their electronic device 21. It is to be appreciated therefore that the examples of the disclosure also cover audio modules 23 that may be arranged for insertion into electronic devices 21.

Figure 6:
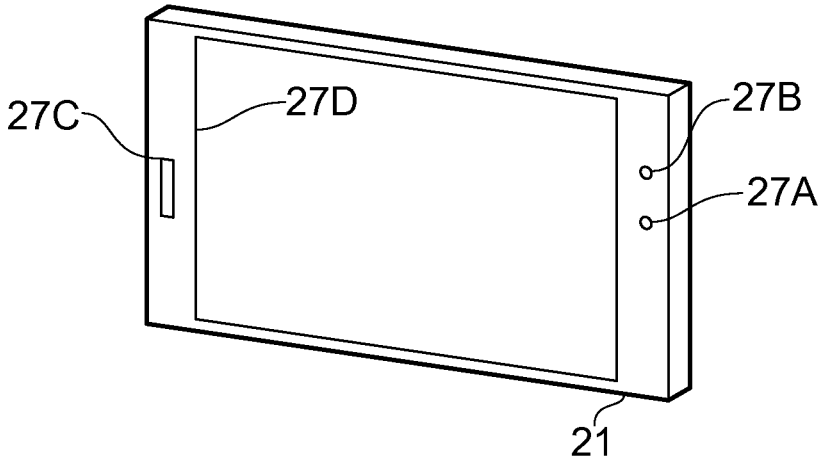
FIG. 6 illustrates an electronic device.

FIG. 6 illustrates another example electronic device 21 according to examples of the disclosure. In the example of FIG. 6 the electronic device 21 comprises a plurality of audio modules 23. The electronic device 21 is arranged to enable a user to position a plurality of different audio modules 23 in different positions within the electronic device. The different positions may be optimized for different applications. In some examples the apparatus 21 may be arranged to enable all of the audio modules 23 to be repositioned. In other examples only some of the audio modules 23 may be repositioned.

The example electronic device 21 of FIG. 6 comprises a plurality of receiving sections 27 within the housing. This may enable a plurality of different audio modules 23 to be connected to the housing 25. This may also enable the different audio modules 23 to be positioned within different receiving sections in the housing.

In other examples the electronic device 21 could comprise a single audio module 23 which could be positioned in any of a plurality of different receiving sections 27. The optimal receiving section 27 may depend on the application that is selected.

In the example of FIG. 6 the housing 25 comprises four receiving sections 27. The different receiving sections are arranged over the front face of the electronic device 21. In the example of FIG. 6 four receiving sections 27 are provided. A first receiving section 27A and a second receiving section 27B are provided on a first edge of the electronic device 21. The third receiving section 27C and the fourth receiving section 27D are provided on a second edge of the electronic device 21. Other arrangements of the receiving sections 27 may be used in other examples of the disclosure. For instance in some examples one or more receiving sections may be provided on the rear face of the electronic device 21.

The different receiving sections 27 may be arranged to receive audio modules 23 arranged for audio capture. In the examples of FIG. 6 each of the audio modules 23 are arranged for audio capture and may comprise one or more microphones.

The electronic device 21 may be arranged so that a user can remove an audio module 23 from a first receiving section and insert the removed audio module into a second different receiving section 27. This enables the audio modules 23 to be located in different positions within the electronic device 21. The user may manually remove the audio modules 23 and insert them into the different receiving sections 23.

The different receiving sections 27 may enable the microphones to be arranged into different spatial arrangements. The different spatial arrangements may be optimized for different functions and applications of the electronic device 21.

For instance, if the electronic device 21 is to be used for making phone calls the audio modules 23 may be positioned within the first receiving section 27A and the fourth receiving section 27D. These receiving sections 27A, 27D may provide for good noise cancellation and so may provide for good quality acoustic signals during a telephone call.

If the electronic device 21 is to be used for stereo video recording the audio modules 23 may again be positioned within the first receiving section 27A and the fourth receiving section 27D as this enables high quality stereo audio to be captured.

If the electronic device 21 is to be used for video recording the audio modules 23 may be positioned within the second receiving section 27B and the fourth receiving section 27D.

It is to be appreciated that other positions of the audio modules 23 may be used in other examples of the disclosure. The optimal position for the microphones may depend on a number of factors such as the intended use of the electronic device 21, the position of other components within the electronic device 21 such as the cameras or the speakers and any other suitable factor.

In the example of FIG. 6 the user may place the different audio modules 23 in different receiving sections of the electronic device 21. The apparatus 1 may detect the location of the audio modules 23 by providing an audio signal and then detecting that a response signal from the particular receiving section 27 is above a threshold.

In the example of FIG. 6 each of the different audio modules 23 may be the same but may be positioned in different locations. In other examples different audio modules 23 with different acoustic parameters may be provided. In such examples the apparatus 1 may be arranged to determine both the location and the acoustic parameters of the audio modules 23.

The apparatus 1 within the electronic device 21 may be arranged to detect selection of an audio application. The audio application may comprise any application which requires processing of an audio signal. The audio application may comprise a communications application, a recording application or any other suitable application.

In some examples the detected selection may comprise a user selecting their preferred use of the electronic device 21. In such examples the user does not need to access or use the application. In some examples the detected selection may comprise a user accessing or opening a specific application such as a video recording application. In other examples the selection could occur in response to an external trigger event. For example, an incoming telephone call or video call could select a telephone call or video call application. In such examples the selection of the audio application may occur automatically without any input from the user of the electronic device 21.

In some examples the selection may comprise an orientation of the electronic device 21 being determined. For instance, the electronic device 21 may comprise one or more sensors, such as an accelerometer, which may detect the orientation of the electronic device 21. Once the orientation has been detected this information may be used to determine the application that is being used.

In response to the detected selection of an audio application the apparatus 1 may be arranged to identify an optimal arrangement for the positions of a plurality of audio modules. The identified optimal arrangement may be predetermined. For instance, information indicative of the optimal arrangement for a given application may be stored in the memory circuitry 7 and retrieved when an audio application is selected.

In some examples information indicative of the optimal arrangement may depend on an orientation of the electronic device 21. For example, the optimal arrangement may be different if a user is recording a video with an electronic device 21 in a portrait mode compared to if the user is recording the video with the electronic device 21 in landscape mode.

In some examples the optimal arrangement may also take into account a current performance of an audio module 23 and/or a receiving section 27. For example a microphone in an audio module could become blocked or damaged. This could be detected by analyzing the signals captured by the microphones. If one or more of the audio modules 23 is determined to be blocked or damaged and alternative arrangement for the positions may be identified.

The apparatus 1 may also enable the electronic device 21 to provide an indication of the optimal position for an audio module within the electronic device 21. The indication may comprise visual information that is displayed on a display of the electronic device 21.

The indication may comprise information that enables a user to position the audio modules 23 in the optimal positions. In some examples the indication may comprise an icon that is displayed adjacent to the receiving sections 27 that provide the optimal spatial arrangement for the audio modules 23. Different icons could be displayed adjacent to the different receiving sections 27. The different icons may indicate the level of performance of the respective receiving section for the selected function of the electronic device 21.

Figure 7A:
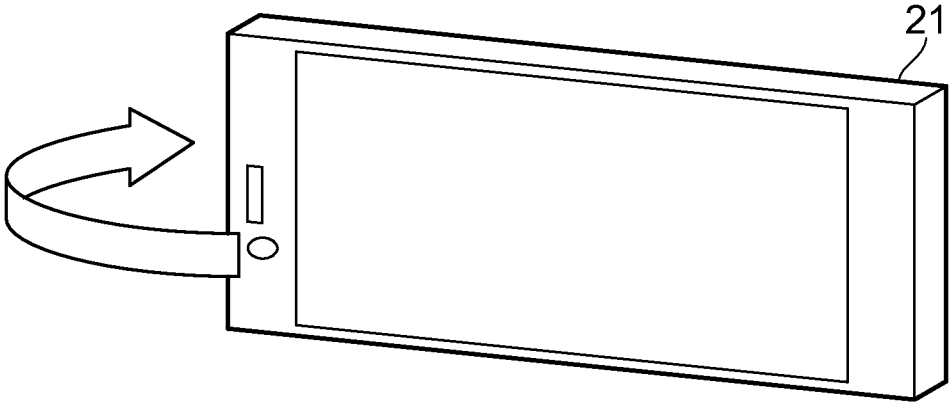
FIGS. 7A and 7B illustrate an electronic device.
Figure 7B:
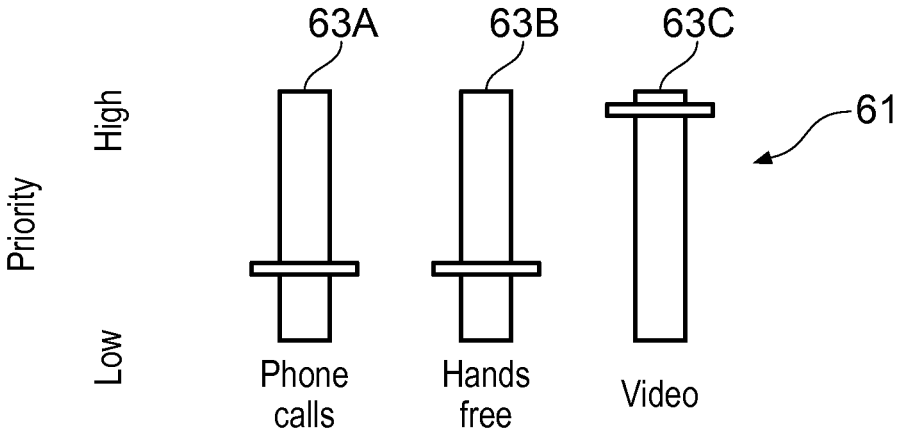

FIGS. 7A and 7B illustrate an example of a user interface 61 that may enable a user to select the preferred application of the electronic device 21. FIG. 7A illustrates an example electronic device 21. The electronic device 21 may be the same as the electronic device 21 of FIG. 6.

FIG. 7B illustrates an example graphical user interface 61 which may be displayed on the display of the electronic device 21. The graphical user interface 61 may enable a user to select an audio application of the electronic device 21. IN the example of FIG. 7B the graphical user interface 61 comprises three sliders 63A, 63B, 63C. Each of the sliders 63A, 63B, 63C is associated with a different function or application of the electronic device 21. In the example of FIG. 7B the first slider 63A is associated with the function of phone calls, the second slider 63B is associated with the function of hands free and the third slider 63C is associated with the function of video recording. A user can select which of these is their preferred function by moving the respective positions of the sliders 63A, 63B, 63C between a high and low setting.

In the example of FIG. 7B the user has indicated that the video application is their preferred function. The video slider 63C has been set to high priority and the phone call slider 63A and the hands fee slider 63B have been set to low priority. In response to this setting the apparatus 1 controls the display to provide an indication of the optimal positions of the audio modules 23 for the video application.

In some examples the functions of the electronic device 21 that are available for user selection may be dependent upon the number and/or type of audio modules 23 that have been connected to the electronic device 21. For example if the user has only inserted one audio module 23 comprising a microphone then the electronic device 21 may only offer functions relating to mono recording of sound to the user. If the user has inserted two audio modules 23 comprising a microphone then the electronic device 21 may offer mono or stereo recovering functions. If the user has inserted three audio modules 23 comprising a microphone then the electronic device 21 may offer mono, or stereo or multichannel functions to the user.

In some examples the determined quality of the audio modules 23 may determine the functions that are offered to the user. For example, if it is determined that audio modules 23 comprising good quality microphones are inserted in the first receiving section 27A and the second receiving section 27B and an audio modules 23 comprising a lesser quality microphone is inserted in the fourth receiving section 27D the apparatus 1 may only offer mono recording functions. If it is determined that audio modules 23 comprising good quality microphones are inserted in the second receiving section 27B and the fourth receiving section 27D and an audio modules 23 comprising a lesser quality microphone is inserted in the third receiving section 27C then the apparatus 1 may offer mono, stereo or multichannel functions.

In the examples of FIGS. 6 to 7B the electronic device 21 comprises a portable communication device. It is to be appreciated that examples of the disclosure could also be provided in other types of electronic devices 21. For instance, a presence capture device may comprise one or more cameras arranged to obtain panoramic images. The presence capture device may also comprise a plurality of microphones arranged in a predetermined geometry. The predetermined geometry may be fixed within the casing of the electronic device 21. The predetermined geometry may comprise eight microphones arranged in a cubic geometry. A microphone could be provided on each corner of the cube. Other geometries may be used in other examples of the disclosure.

Examples of the disclosure may enable a user to move the microphones to different positions within the geometry depending on the use of the presence capture device. For example if the user is standing behind the presence capture device the user may be talking or creating other noise which may be undesirable for the presence capture. In such examples the electronic device 21 may provide an indication that instructs the user to position one or more microphones on the front of the electronic device 21.

In some examples each of the microphones within the audio modules 23 may be identical in the example electronic devices of FIGS. 6 to 7A. In such examples the position of the audio modules 23 may be the only change that is needed to optimize the electronic device 21 for different applications. In other examples different audio modules 23 may have different parameters, for example different quality microphones may be provided in different audio modules. In such examples different processing may be used for different audio modules 23.

Figure 8:
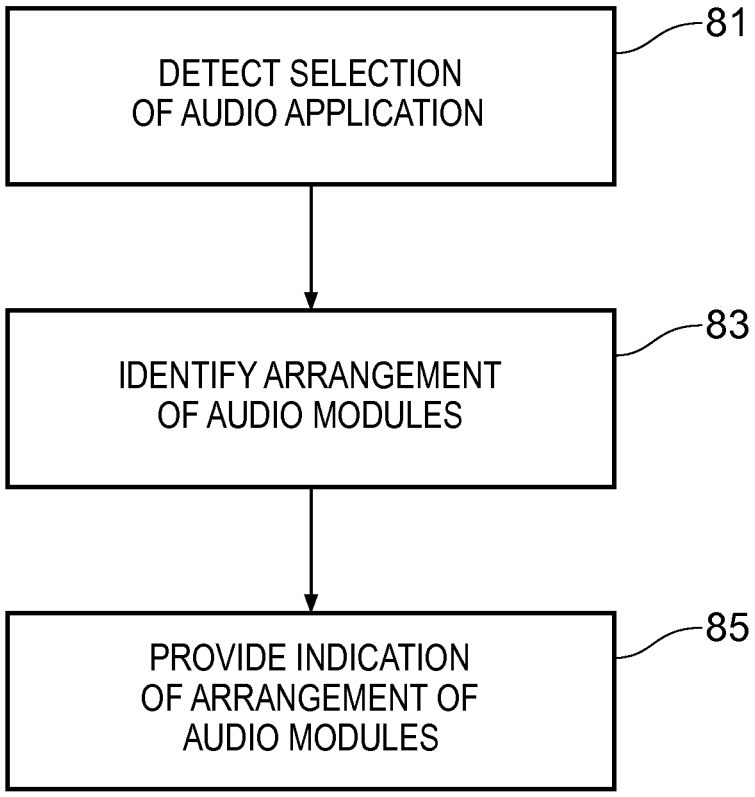
FIG. 8 illustrates a method.

FIG. 8 illustrates a method which may be implemented by the apparatus 1 and electronic devices 21 as described above. The method comprises, at block 81 detecting selection of an audio application. At block 83 the method comprises identifying an optimal arrangement for the positions of a plurality of audio modules 23 within an electronic device 21 for the audio application; and at block 85 the method comprises providing an indication to the user of the optimal arrangement of the plurality of audio modules 23.

Examples of the disclosure provide an electronic device 21 which can be optimised for use in different audio applications. The user of the electronic device 21 does not need to have any understanding of the best arrangements for the audio modules 23 as this information is determined by the apparatus 1 and provided to the user via any suitable means.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

processing circuitry; and memory circuitry including computer program code, the memory circuitry and the computer program code configured to, with the processing circuitry, enable the apparatus to:

detect an audio module in response to the audio module being mechanically located within a housing of the apparatus and electrically connected to circuitry within the housing when the audio module is located within the housing, the audio module comprising a casing configured to house at least an audio transducer and an acoustic cavity associated with the audio transducer that are located within the housing when the audio module is located within the housing, wherein the audio module is configured to physically replace a default audio module within the housing of the apparatus, wherein the default audio module is removed from the housing so as to insert the audio module within the housing of the apparatus, the default audio module comprising a default audio transducer and a default acoustic cavity associated with the default audio transducer;

determine one or more parameters of the audio module within the housing; and enable processing audio signals with one or more signal processing algorithms associated with the audio module in accordance with the determined one or more parameters, wherein the one or more signal processing algorithms are configured in accordance with the detected audio module.

2. The apparatus as claimed in claim 1 wherein the audio module comprises at least one sound outlet.

3. The apparatus as claimed in claim 1 wherein the processing of the audio signals is modified so that different processing is associated with different audio modules.

4. The apparatus as claimed in claim 3 wherein modifying the processing of the audio signals associated with the audio module comprises changing algorithms associated with processing the audio signals.

5. The apparatus as claimed in claim 3 wherein modifying the processing of the audio signals associated with the audio module comprises modifying the audio signals when the audio signals are configured to be provided from the audio module to the apparatus.

6. The apparatus as claimed in claim 3 wherein modifying the processing of the audio signals associated with the audio module comprises modifying the audio signals when the audio signals are configured to be provided from the apparatus to the audio module.

7. The apparatus as claimed in claim 1 wherein the one or more parameters of the audio module comprises at least one of: a frequency response, a type of transducer, or a specification of the transducer.

8. The apparatus as claimed in claim 1 wherein determining the one or more parameters of the audio module comprises at least one of: detecting metadata provided by the audio module; detecting a ground pin location of the audio module; or determining a frequency response of the audio module.

9. The apparatus as claimed in claim 1 wherein the one or more parameters of the audio module comprises a position of the audio module.

10. The apparatus as claimed in claim 9 wherein determining the position of the audio module comprises providing an audio signal; and detecting if a response signal is above a threshold.

11. The apparatus as claimed in claim 9 wherein the processing circuitry and memory circuitry are further configured to enable the apparatus to provide an indication of the position for the audio module.

12. The apparatus as claimed in claim 11 wherein the indication is provided in response to detecting user selection of a mode of operation of the apparatus.

13. The apparatus as claimed in claim 1 wherein the apparatus is further enabled to:

detect a plurality of audio modules simultaneously connected to the apparatus; and determine the one or more parameters for each of the plurality of audio modules.

14. The apparatus as claimed in claim 1, wherein the apparatus comprises an electronic device, and wherein the electronic device comprises one or more connecting portions arranged to receive the audio module.

15. The apparatus as claimed in claim 14 wherein the audio module comprises a part of a housing of the electronic device.

16. The apparatus as claimed in claim 1 such that the audio module can be disconnected and reconnected to the apparatus.

17. The apparatus as claimed in claim 1, wherein the audio module comprises a different audio module comprising at least one of:

a different type of audio transducer;

a different quality of audio transducer; or the audio module casing having the same size and shape of the default audio module.

18. A method comprising:

detecting an audio module in response to the audio module being mechanically located within a housing of an apparatus and electrically connected to circuitry within the housing when the audio module is located within the housing, the audio module comprising a casing configured to house at least an audio transducer and an acoustic cavity associated with the audio transducer that are located within the housing when the audio module is located within the housing, wherein the audio module is configured to physically replace a default audio module within the housing of the apparatus, wherein the default audio module is removed from the housing so as to insert the audio module within the housing of the apparatus, the default audio module comprising a default audio transducer and a default acoustic cavity associated with the default audio transducer;

determining one or more parameters of the audio module within the housing; and enabling processing audio signals with one or more signal processing algorithms associated with the audio module in accordance with the determined one or more parameters, wherein the one or more signal processing algorithms are configured in accordance with the detected audio module.

19. The method as claimed in claim 18 wherein the method further comprises:

detecting a plurality of audio modules simultaneously connected to the apparatus; and determining the one or more parameters for each of the plurality of audio modules.

20. An apparatus comprising:

processing circuitry; and memory circuitry including computer program code, the memory circuitry and the computer program code configured to, with the processing circuitry, enable the apparatus to:

detect selection of an audio application;

based on the selected audio application, identify a positioning for each of a plurality of audio modules to be inserted within a housing of the apparatus for the audio application with respect to the apparatus, each audio module comprising at least a casing configured to house an audio transducer and an acoustic cavity associated with the audio transducer that are inserted within the housing of the apparatus when the audio module is inserted within the housing, wherein the audio module is configured to physically replace at least a default audio module within the housing of the apparatus, wherein the default audio module is removed from the housing so as to insert the audio module within the housing of the apparatus, the default audio module comprising a default audio transducer and a default acoustic cavity associated with the default audio transducer, and wherein the audio module provides a different audio performance than the default audio module; and provide an indication for display to a user of the positioning of the plurality of audio modules within the housing of the apparatus.

21. A method comprising:

detecting selection of an audio application;

based on the selected audio application, identifying a positioning for each of a plurality of audio modules to be inserted within a housing of an electronic device for the audio application with respect to the electronic device, each audio module comprising a casing configured to house at least an audio transducer and an acoustic cavity associated with the audio transducer that are inserted within the housing of the electronic device when the audio module is inserted within the housing, wherein the audio module is configured to physically replace at least a default audio module within the housing of the electronic device, wherein the default audio module is removed from the housing so as to insert the audio module within the housing of the electronic device, the default audio module comprising a default audio transducer and a default acoustic cavity associated with the default audio transducer, and wherein the audio module provides a different audio performance than the default audio module; and providing an indication for display to a user of the positioning of the plurality of audio modules within the housing of the electronic device.

* * * * *